United States Patent [19]

Yakovlev et al.

[11] 4,302,959

[45] Dec. 1, 1981

[54] METHOD OF FORMING HELICAL SPRINGS

[76] Inventors: Vladimir K. Yakovlev, ulitsa Moskovskaya, 25, kv. 9; Elektron P. Lugovoi, pereulok Krasnoarmeisky, 73, kv. 21; Vasily A. Ivankov, pereulok Krasnoarmeisky, 92, kv. 16, all of Azov Rostovskoi oblasti, U.S.S.R.

[21] Appl. No.: 55,296

[22] Filed: Jul. 5, 1979

Related U.S. Application Data

[63] Continuation of Ser. No. 856,766, Nov. 29, 1977, abandoned.

[51] Int. Cl.[3] ..... B21F 3/04

[52] U.S. Cl. ..... 72/138; 72/143; 72/145

[58] Field of Search ..... 72/49, 50, 138, 139, 72/142, 143, 144, 145, 371, 403

[56] References Cited

U.S. PATENT DOCUMENTS

| | | | |
|---|---|---|---|
| 2,038,488 | 4/1936 | Gogan | 72/142 |
| 3,052,277 | 9/1962 | Stegmann | 72/332 |
| 3,139,136 | 6/1964 | Chambers | 72/148 |
| 3,296,851 | 1/1967 | Breuer | 72/403 |
| 3,470,721 | 10/1969 | Scheublein et al. | 72/144 |

FOREIGN PATENT DOCUMENTS

| | | | |
|---|---|---|---|
| 2006876 | 10/1971 | Fed. Rep. of Germany | 72/138 |

*Primary Examiner*—Ervin M. Combs
*Attorney, Agent, or Firm*—McAulay, Fields, Fisher, Goldstein & Nissen

[57] ABSTRACT

The method of forming helical springs and the installation for carrying same into effect relate to manufacture of springs and can be used with particular advantage for the purpose of forming helical springs by winding hot bars on a rotating mandrel.

According to the invention, the winding of the bar on the mandrel is effected in the plane of the bar feed by pressing the bar against the mandrel over part of the circumference thereof for the purpose of forming spring coils. Each formed coil is relieved of the forming pressure and moved by a predetermined amount to the free end of the mandrel in order to set the coil pitch.

The installation for carrying said method into effect comprises a plurality of sectors mounted equidistantly round the mandrel, said sectors being adapted for moving radially for applying a pressure force to the bar and for making a traversing movement along the mandrel in order to pass under a bar guiding arrangement and a pitch setting arrangement comprised in the installation. The pitch setting arrangement has an arm located in the path of movement of the formed coil and designed for moving the coil towards the free end of the mandrel.

This makes it possible to form springs of any pitch and to remove the spring from the mandrel as it is coiled.

5 Claims, 10 Drawing Figures

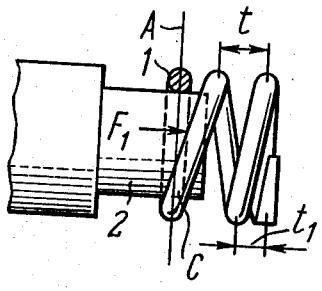
FIG.1
FIG.2
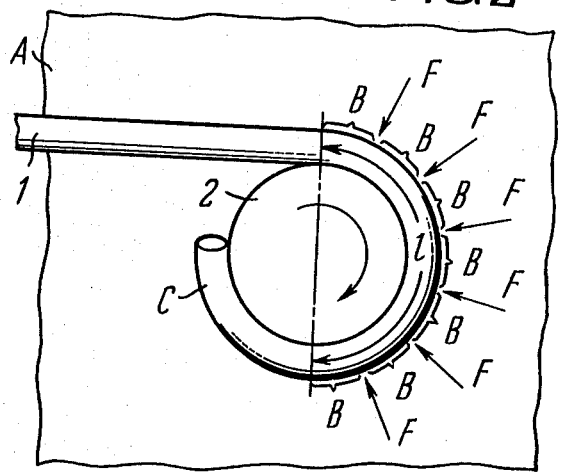

METHOD OF FORMING HELICAL SPRINGS

This is a continuation of application Ser. No. 856,766, filed Nov. 29, 1977, now abandoned.

The present invention relates to manufacture of springs from bar lengths and has particular reference to methods of forming helical springs on a rotating mandrel and installations for carrying same into effect.

The invention can be used with particular advantage to form large helical springs by winding hot bars on a rotating mandrel.

The prior art knows essentially two methods of forming helical springs by coiling bars on a rotating mandrel and a great many various installations for carrying same into effect.

By one of the methods of forming helical springs, a bar is wound at a preset pitch on a cantilever-mounted rotating mandrel, the coil pitch being set by arranging for the bar to be directed by a helical groove in a guide installed parallel to the mandrel. However, to make springs with another pitch by this method, the guide has to be changed to one having the helical groove of the appropriate pitch.

By another method of forming helical springs, the spring coil pitch is set by traversing the bar along the mandrel at a constant speed by the use of an appropriate arrangement or by moving the mandrel relative to the bar. Change of pitch is effected by changing the bar traversing speed or the speed of the mandrel movement relative to the bar. Thus, in the installations working by this method provision must be made of arrangements for regulating the speed of bar traverse or mandrel movement relative to the bar. Also provision must be made of arrangements for holding the end of the bar to the mandrel while winding. The need for such arrangements substantially complicates the construction of the installation.

Furthermore, the installations under consideration have to employ a mandrel of considerable length in order to completely wind the whole bar. This increases the size of the installation and complicates the removal of the formed spring from the mandrel. Moreover, the truth of the coil pitch may be affected when removing the spring from the mandrel, particularly in the case of long springs.

In the installations known in the prior art it is difficult to mechanize the feeding of single bars, especially in the cases where both ends of the bar are made in the form of a rectangular-section cone frustum (i.e. the bar ends are tapered). During the process of winding the bar onto the mandrel the free end of the bar becomes twisted due to helical winding of spaced coils. Therefore, the free end of the bar has to be constantly held and oriented in the required position. Another drawback is that, after coiling the bar on the mandrel, the free end of the bar has to be squared by bending it through the use of additional mechanisms, the spring forming process being thereby complicated.

It is an object of the present invention to eliminate the disadvantages described above.

It is a specific object of the present invention to provide a method of forming helical springs and an installation for carrying same into effect wherein the process of coiling the bar on the mandrel and setting the coil pitch will be improved so as to eliminate twisting of the free end of the bar.

It is a further object of the present invention to simplify the spring forming process and increase the operating efficiency thereof by saving time taken to remove the formed spring from the mandrel.

It is a still further object of the present invention to provide such a method of forming helical springs and an installation for carrying same into effect which will make it possible to make springs of any pitch and length.

It is a still further object of the present invention to provide such a method of forming helical springs and an installation for carrying same into effect which will make it possible to make springs with both right and left hand of helix and form end coils.

These and other objects are achieved by providing a method of forming helical springs whereby a bar is wound at a preset pitch on a cantilever-mounted rotating mandrel, the winding of the bar on said rotating mandrel being effected in the plane of bar feed by pressing the bar against the mandrel over part of the circumference thereof for the purpose of forming coils each of which is relieved of the forming pressure over the rest of the mandrel circumference and is moved by a preset amount towards the free end of the mandrel for setting the coil pitch.

It is desirable that the bar be pressed against the mandrel substantially over one-half the circumference thereof.

The installation designed for carrying said method into effect comprises a bed which carries a spindle with a cantilever-mounted mandrel designed for coiling a bar during mandrel rotation, an arrangement for guiding the bar in the coiling process, and an arrangement for setting the pitch of coils. According to the invention, the spindle mounts a plurality of sectors which are equidistantly spaced round the mandrel and arranged to rotate together with the spindle, said sectors being adapted to move radially for the purpose of pressing the bar against the mandrel over part of the circumference thereof in the plane of bar feed and forming coils, and to traverse along the mandrel for the purpose of passing under the bar guiding arrangement and the pitch setting arrangement, said pitch setting arrangement being provided with an arm designed to move each coil by a preset amount towards the free end of the mandrel and located in the path of movement of the coil relieved of the sector pressure.

Thus, the method of forming helical springs and the installation for carrying same into effect which constitute the present invention provide for curving the bar over the mandrel in the plane of bar feed whereby turning or twisting of the free end of the bar is excluded, owing to which the process of spring forming can be fully mechanized.

The movement imparted to each coil after it has been formed and relieved of the forming pressure sets the coil pitch and also removes the spring from the mandrel by virtue of shifting all the formed coils towards the free end of the mandrel. This feature makes it possible to reduce the spring forming process by omitting the operation of withdrawing the mandrel from the spring and obviates the need for returning all the mechanisms into the initial position. Furthermore, the mandrel need not be substantially long inasmuch as, with the spring forming method involved, the mandrel length may be just sufficient to accommodate one or two spring coils, which in no way affects the length of the spring being wound because the formed coils are shifted towards the free end of the mandrel and, therefore, springs of practically infinite length can be obtained.

The expedient of pressing the bar to the mandrel substantially over one-half the circumference thereof (i.e. somewhat greater or less than one-half the mandrel circumference) makes it possible to surely curve the coil being formed and also to make springs with right or left hand of helix.

For said sectors to be moved radially and along the mandrel, the installation constituting the present invention has a program drum fixedly mounted coaxially with the spindle and kinematically connected with each of the sectors so that any preset motion can be transmitted to the sectors.

In one of the embodiments of the invention, the program drum has an outer and an inner profiled surface. The outer profiled surface is designed for moving the sectors radially and the inner profiled surface is designed for moving the sectors lengthwise of the mandrel. The sectors are mounted on the spindle by means of slides which are equidistantly spaced round the spindle circumference and are arranged for movement along the spindle on ways provided therein. The slides are provided with rollers arranged to interact with the inner profiled surface of the program drum and have levers each of which carries a sector articulated to one end and a roller mounted on the other end, said roller being arranged to interact with the outer profiled surface of the program drum.

It is desirable that each sector be formed by a slide, said slide being resiliently loaded towards the mandrel, arranged to move on ways provided on the end of the spindle slide, and carrying a sector plate whose surface facing the mandrel is profiled to correspond with the profile of the bar and the outside diameter of the spring being formed.

This constructional arrangement of the sectors makes it possible to regulate the pressure exerted on the bar in forcing it to the mandrel so that the bar is not deformed and no marks are left thereon.

In another embodiment of the invention, the program drum has a profiled groove accommodating spring-loaded rollers articulated to the sectors through pairs of levers whose pivots are equidistantly mounted on the circumference of the spindle. This arrangement of the components materially simplifies the construction of the entire installation.

According to the invention, the pitch setting arrangement comprises a lever articulated to the bed and having an arm attached to the lever end, which arm is bevelled on the side facing the free end of the mandrel, a power cylinder whose piston rod is articulated to the lever for the purpose of moving said lever and holding it in a preset position, and two adjustably mounted stops arranged to limit the movement of the lever and located near the other end thereof.

This construction of the pitch setting arrangement makes it possible to produce springs of any pitch and also to vary the coil pitch during the winding process for the purpose of forming end coils.

The power cylinder is designed for moving the lever in varying the coil pitch, whereas the arm bevel makes it possible to obtain a constant coil pitch and to form closely wound springs without the use of the power cylinder.

Mounted near the lever is a coil count-off initiation pickup arranged to interact with said lever through a spring-loaded stop and connected electrically in a conventional way with a coil counter incorporated in a conventional manner in the power cylinder control system.

This construction simplifies the installation and materially increases the operating efficiency thereof since it provides for feeding bars to the mandrel continuously without disengaging the spindle drive.

Now the invention will be described in detail with reference to the accompanying drawing in which:

FIG. 1 depicts the process of coiling a bar on the mandrel at a preset pitch.

FIG. 2 shows the process of forming a spring coil.

Figure 3:
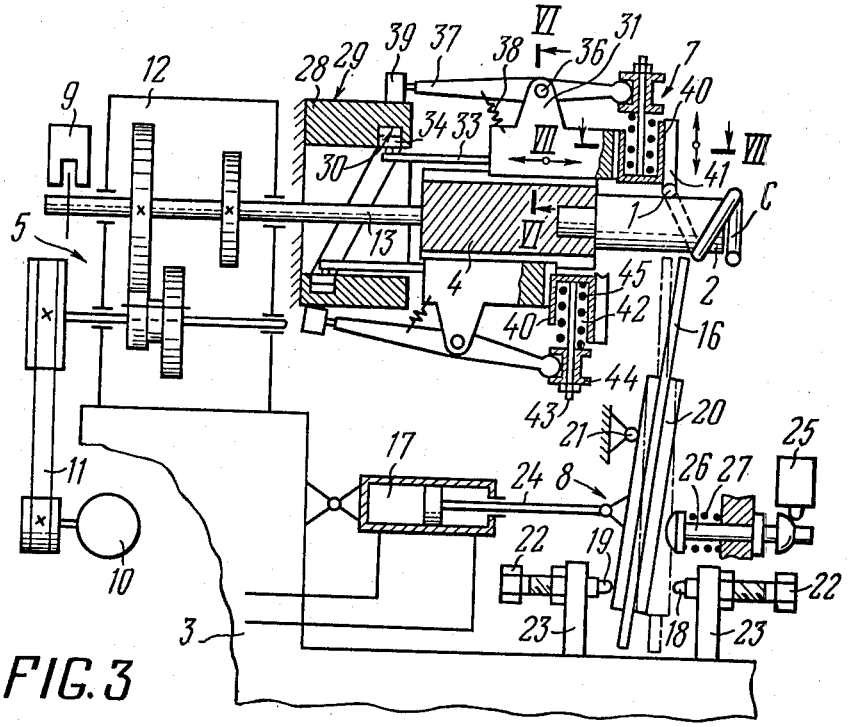
FIG. 3 is a fragmentary sectional view of the helical spring forming installation constructed according to the invention.

According to the method constituting the present invention, helical springs are formed from bars as follows:

Bar 1 (FIGS. 1 and 2), in a cold or hot state, is wound at a preset pitch "t" on a cantilever-mounted rotating mandrel 2. The winding of the bar 1 on the rotating mandrel 2 is effected in the plane of bar feed, i.e. in the imaginary vertical plane A perpendicular to the mandrel axis.

Bar 1 is wound on the mandrel 2 in the plane A by pressing the bar to the mandrel on successive portions B (FIG. 2) over part of the mandrel circumference, whereby coils C are formed.

The bar portions B can be pressed against the mandrel 2 round the arc "l" equal to one-half the circumference of the mandrel 2, or slightly greater or less than one-half the mandrel circumference. The bar portions B are pressed against the mandrel 2 by a force F applied radially to the bar 1 throughout the arc "l" as shown in FIG. 2. This force causes the bar to curve round the mandrel 2. By virtue of the attendant frictional forces the bar winds about the mandrel and forms coils C.

On the rest of the mandrel circumference each formed coil C is relieved of the force F and shifted by a force $F_1$ (FIG. 1) by a preset amount to the free end of the mandrel 2 whereby the coil pitch "t" is set up. The force $F_1$ is applied to the coils in the direction approximately parallel to the axis of the mandrel 2.

The method involved can be used for forming a right-hand spring helix, in which case the bar is fed over the mandrel, and for forming a left-hand spring helix, in which case the bar is fed underneath the mandrel and the direction of mandrel rotation is reversed.

The installation for carrying into effect the method of forming helical springs is shown diagrammatically in FIG. 3 and described in detail below.

A bed 3 mounts a spindle 4 with a mandrel 2 cantilever-mounted therein, a spindle drive 5, a bar guiding arrangement 6 (FIG. 4), a plurality of sectors 7, a pitch setting arrangement 8 (FIG. 3), and a coil counter 9 arranged to count the revolutions of the spindle 4 in any manner known in the art.

The mandrel 2 is clamped in the spindle in any conventional way. During the rotation of the mandrel 2 the bar 1 is wound thereon, whereby spring coils C are formed.

The drive 5 of the spindle 4 is of the conventional construction and comprises an electric motor 10, a belt transmission 11 and a gearbox 12 on whose output shaft 13 is mounted the spindle 4.

Figure 4:
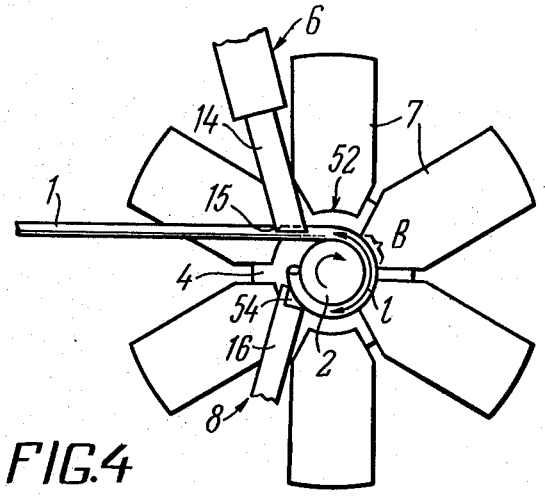
FIG. 4 is a schematic view showing the location of the sectors, the bar guiding arrangement and the pitch setting arrangement.

The bar guiding arrangement 6 (FIG. 4) comprises a rod 14 cantilever-mounted on bed 3 (not shown in FIG. 4). The free end of the rod 14 is located in the vicinity of the mandrel 2 as shown in FIG. 4 and has a guide groove 15 for the bar 1 (FIG. 5) to slide in during the winding process. The guide groove 15 feeds the bar 1 to the mandrel 2 in the imaginary vertical plane A perpendicular to the mandrel axis.

Other embodiments of the guiding arrangement are possible wherein use can be made of rollers or the guide rod may be provided with a hole arranged to direct the bar in the plane A perpendicular to the mandrel axis.

The pitch setting arrangement 8 (FIG. 3) comprises an arm 16, a power cylinder 17, for example a pneumatic cylinder, and two stops 18 and 19.

The arm 16 is cantilever-mounted on one end of a lever 20 which is articulated by means of a pivot pin 21 to the bed 3. The free end of the arm 16 is located near the mandrel 2 in the path of movement of the coil, on the same side as the bar guiding arrangement 6, as shown in FIG. 4. The other end of the lever 20 (FIG. 3) is located between the stops 18 and 19 which are mounted adjustably for changing the pivotal movement of the lever 20 with the arm 16. The position of the stop 18 determines the amount of the pitch "$t_1$" (FIG. 3) of the spring end coils. The position of the stop 19 (FIG. 3) determines the amount of the pitch "t" (FIG. 1) of the spring active coils. Adjustment of each of the stops 18 and 19 is made by the use of a screw 22 one end of which mounts the associated stop and the other end is engaged in a nut fixedly mounted in a bracket 23 provided on the bed 3.

The power cylinder 17 is attached to the bed 3 in a conventional way. The piston rod 24 of the power cylinder 17 is articulated to the lever 20 so as to move it for the purpose of changing the pitch of the spring coils being wound. Of course, the power cylinder 17 is provided with all the necessary working equipment, including a conventional control system into which is incorporated in a conventional way the coil counter (the power cylinder control system and the connection thereof with the coil counter are not shown in the accompanying drawings inasmuch as they are widely known to those versed in the art).

Mounted near the lever 20 is a coil count-off initiation pickup 25 of any design known in the art. The pickup 25 is electrically connected in a conventional way with the coil revolution counter 9 and has a spring-loaded stop 26 arranged to interact with the lever 20 and to effect the on/off control of the pickup. The stop 26 passes freely through a hole in the bed 3 and has a shoulder against which abuts one end of a spring 27 whose other end bears against the bed 3. This construction allows the stop 26 to be reciprocated by the action of the spring 27 or the lever 20 for the other shoulder of the stop to operate a microswitch incorporated in the pickup 25.

Sectors 7 (for example, six sectors as shown in FIG. 4) are mounted equidistantly round the mandrel 2 and are adapted to be moved radially for pressing portions of the bar 1 in successive steps against the mandrel in the plane of the bar feed over part of the mandrel circumference, thereby forming spring coils.

All the sectors 7 are mounted on the spindle 4 (FIG. 3) so as to rotate together with the mandrel 2 and are adapted to be moved along the mandrel so as to pass under the pitch setting arrangement 8 (FIG. 4) and the bar guiding arrangement 6 and return into the initial position. The movement of the sectors along the mandrel is effected mainly in that part of the circumference thereof where the bar is not subjected to the forming pressure as shown in FIG. 4.

To provide for the radial movement of the sectors 7 and the movement thereof along the mandrel 2, a program drum 28 is installed coaxially with the spindle 4 (FIG. 3). The program drum 28 is kinematically connected with each of the sectors 7 and is mounted fixedly in relation to the spindle 4. The drum 28 has a hole through which output shaft 13 passes freely.

Figure 5:
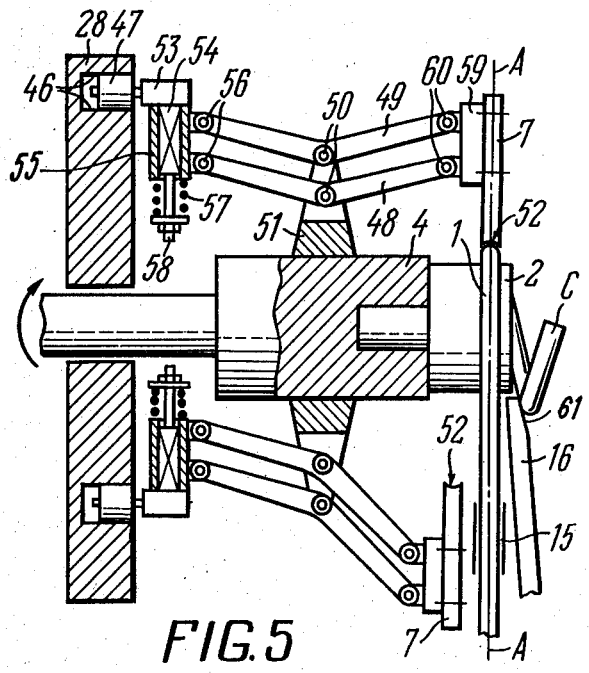
FIG. 5 shows the spindle with the sectors and program drum mounted thereon (an enlarged fragmentary sectional view).

The program drum 28 may have one profiled surface as shown in FIG. 5, said profiled surface being adapted for imparting to the sectors 7 both the radial motion and the motion along the mandrel 2, or it may have two profiled surfaces as shown in FIG. 3, each of said surfaces being designed specifically for one of said motions.

The program drum 28 shown in FIG. 3 has an outer profiled surface 29 and an inner profiled surface 30. The outer profiled surface 29 is designed to impart the radial motion to the sector 7. The inner profiled surface 30 is designed to impart the sectors 7 the motion along the mandrel 2.

Figure 6:
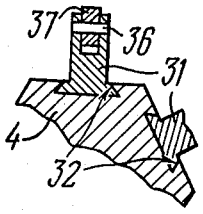
FIG. 6 is a sectional view on the line VI—VI of FIG. 3.
Figure 7:
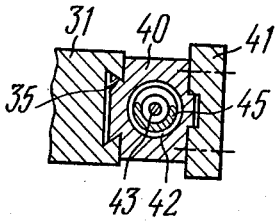
FIG. 7 is a sectional view on the line VII—VII of FIG. 3.

With this constructional arrangement of the program drum 28, the sectors 7 are mounted on the spindle 4 by means of slides 31 which are equidistantly located round the circumference of the spindle 4 and are arranged to move therealong on ways 32 (FIG. 6). On one end of each slide 31 is provided a pusher 33 (FIG. 3) with a roller 34 mounted thereon. Ways 35 (FIG. 7) are provided on the slides 31 at the other ends thereof.

The roller 34 (FIG. 3) is arranged to interact with the inner profiled surface 30 of the program drum. When the spindle 4 rotates, the roller rides on said surface, reciprocating the slides 31 along the spindle 4. Each slide 31 carries a lever 37 which is articulated thereto by means of a pivot pin 36 and is connected to said slide by means of a spring 38. One end of the lever 37 carries a roller 39 arranged to interact with the outer profiled surface 29 of the program drum 28. Riding on said surface, the roller 39 in conjunction with the spring 38 causes the lever 37 to rock in radial planes relative to the mandrel. The other end of the lever 37 of each slide 31 carries the sector 7 which, owing to the rocking movement of the lever 37, makes a radial movement.

Each sector 7 is formed by a slide 40 which is resiliently loaded against the mandrel 2, is arranged to move on the ways 35 (FIG. 7) of the slide 31 and carries a sector plate 41 (FIG. 3). The slide 40 has a space 42 which accommodates a rod 43 attached to the slide. The rod 43 mounts a socket 44 which receives the end of the lever 37, whereby an articulated connection is formed between the lever 37 and the slide 40. The space 42 in the slide 40, between the bottom thereof and the socket 44, accommodates a spring 45 which is fitted on the rod 43 and is arranged to resiliently load the slide 40 towards the mandrel 2.

The program drum 28 shown in FIG. 5 has one profiled surface made in the form of a profiled groove 46. This groove accommodates spring-loaded rollers 47 articulated to the sectors 7 through pairs of levers 48 and 49, the number of the lever pairs corresponding to the number of the sectors. In each pair the levers 48 and 49 are located one underneath the other and are mounted on a bracket 50 by means of pivots 51 as shown in FIG. 5. The brackets 51 are mounted equidistantly round the spindle 4. The sectors 7 have a compound motion, viz., during the travel on the arc "1" (FIG. 4) equal substantially to one-half the circumference of the mandrel 2 the sectors 7 move radially in the plane A of the bar feed, then they leave this plane and, while moving radially, traverse along the mandrel.

Figure 8:
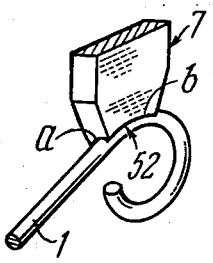
FIG. 8 depicts the action of the sector on the bar.

The sectors 7 shown in FIG. 5 and the sector plates 41 shown in FIGS. 3 and 4 have surfaces 52 which face the mandrel 2 and are profiled as shown in FIG. 8 where the side "a" corresponds with the profile of the bar 1 and the side "b" corresponds with the outside diameter of the spring being formed.

Each of the rollers 47 (FIG. 5) is mounted on an L-shaped bracket 53 having a rectangular portion 54 situated in a shackle 55, which shackle is attached to the pair of the levers 48 and 49 by means of articulated joints 56. Each bracket 53 has a portion which projects from the shackle 55 and mounts a spring 57, said spring abutting against a stop 58 formed on said portion of the bracket. This construction enables the sectors 7 to exert pressure on a bar 1 of varying cross-section, provides against damage to the bar during the application of the pressure force, and makes it possible to regulate the force which presses the bar against the mandrel, which is a point of great importance in forming springs from hot bars.

The articulated connection of the sector 7 to the levers 48 and 49 is effected through a shackle 59 which is attached to said levers by means of pivots 60. The sector 7 is attached to the shackle 59 in a conventional way.

Figure 9:
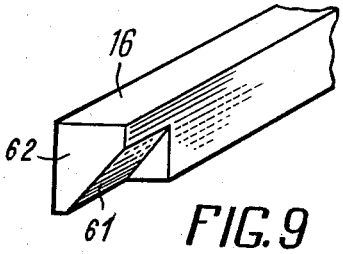
FIG. 9 is a fragmentary view of the arm.

The end of the arm 16 (FIGS. 5 and 9) facing the free end of the mandrel 2 has a bevel 61 which may be disposed at an angle to the end face 62 of the arm 16. The function of the bevel 61 is to displace the end of the first coil of the spring being formed and deflect, as shown in FIG. 5, the coils C so as to set up the pitch "t" and "$t_1$" (FIG. 10) of the active and end coils respectively. Other embodiments are also possible wherein the end of the arm may be provided with a freely rotating roller or else the bevel 61 or said roller may be profiled to correspond with the bar diameter in order to provide against damaging the bar, especially in the case of hot coiling.

The installation for carrying into effect the method of forming helical springs operates as follows:

The spindle 4 together with the mandrel 2 and the sectors 7 is driven by the electric motor 10 through the V-belt transmission 11 and the gearbox 12, the latter providing for changing the angular speed of the spindle 4.

The bar 1 (FIGS. 4 and 5) is fed in the plane A to the mandrel 2 through the groove 15 of the rod 14 incorporated in the guiding arrangement 6. The sector 7 which is first to enter the plane A while traversing along the mandrel 2 and radially presses the end of the bar to the mandrel. Moving radially, the sector 7 presses the bar 1 against the mandrel 2 with a force F, by the action of which force the bar curves round the rotating mandrel and, by virtue of attendant friction forces, becomes wound on the mandrel, the spring forming force being applied to successive bar portions B the length of which is equal to the length of the sector surface 52. The sector 7 holds the bar 1 pressed against the mandrel 2 on the arc "1". After the bar 1 (FIG. 4) has been pressed against the mandrel 2 by the first sector 7, the other sectors 7 enter the plane A is succession and apply a spring forming force to the bar, the application of said force being effected in such a manner that at any instant the bar is pressed against the mandrel by at least two sectors, i.e. as one sector relieves the pressure, the third sector therefrom applies the pressure to the bar. The action described above forms spring coils C.

After each sector 7 turns together with the mandrel 2 through the arc "1", while pressing the bar 1 to the mandrel 2, the sector involved is imparted a traversing movement along the mandrel during which said sector moves off the bar, relieving it of the pressure force. This movement is given to each sector through the levers 37 (FIG. 3) and the slides 31 whose rollers 39 and 34 ride on the profiled surfaces of the program drum 28, or, as shown in FIG. 5, said movement is imparted to the sectors through the pairs of the levers 48 and 49 whose rollers 47 ride in the groove 46 of the program drum 28.

With this mode of movement, the sectors 7 leave the plane A as shown in FIGS. 4 and 5 and travel underneath the pitch setting arrangement 8 and the bar guiding arrangement 6. During further rotation of the spindle 4 the sectors 7 move in reverse, entering the plane A in succession, and, while moving radially, press the bar 1 against the mandrel 2.

After the bar end formed into a coil C has been relieved of the pressure exerted by the sector 7, it gets onto the bevel 61 of the arm 16. At the beginning of winding the bar on the mandrel 2 the lever 20 (FIG. 3) with the arm 16 is in an intermediate position between the stops 18 and 19, being held in this position by the spring-loaded stop 26 of the pickup 25. By the action of the coil C the arm 16 and the lever 20 are moved to the stop 18 whereby the spring-loaded stop 26 is caused to operate the microswitch incorporated in the pickup 25. The pickup 25 sends a signal to the coil counter 9 and the latter starts counting off the formed coils. In this position, the arm 16 acts on the formed coil C and deflects it towards the free end of the mandrel 2.

Inasmuch as the stop 18 is installed so that it provides for obtaining a spring pitch equal to the pitch "$t_1$" of the end coils, the preset number of end coils with the pitch "$t_1$" is formed during further rotation of the mandrel.

After the coil counter has counted off the preset number of end coils, it sends a signal for initiating the operation of the power cylinder 17. With the power cylinder at work, the piston rod 24 moves the arm 16 and the lever 20 to the other stop 19 with the result that the pitch "$t_1$" of the end coil is increased to the pitch "t" of the active coils without interrupting the process of spring formation, the rate of change of the pitch depending on the rate of movement of the piston rod 24 of the power cylinder 17.

Now the active coils of the springs are wound at the pitch "t", the required number of the coils being counted off by the coil counter 9. After the preset number of active coils has been counted off, the coil counter sends a signal for the power cylinder 17 to move the lever 20 and arm 16 to the stop 18. With the arm 16 in this position, end coils are formed at the pitch "$t_1$" from the remaining portion of the bar.

Figure 10:
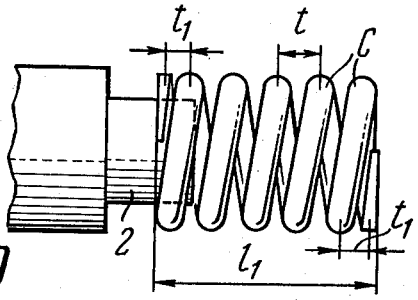
FIG. 10 shows a spring formed by the method constituting the invention.

Thus, a spring of the preset length "$1_1$" as shown in FIG. 10 is formed, said spring being withdrawn from the mandrel 2 as the coils are wound. After the winding of the spring is completed, the spring-loaded stop 26 of the pickup 25 forces the lever 20 with the arm 16 by the action of the spring 24 into an intermediate position between the stops 18 and 19, thereby preparing the coil counter 9 for the next cycle of operation and feeding of another bar, whereupon the cycle is repeated.

In order to change the hand of helix of the spring to be formed, it is necessary to interchange the positions of the bar guiding arrangement 6 and the pitch setting arrangement 8, and reverse the direction of rotation of the spindle 4, the bar being fed underneath the mandrel 2.

What is claimed is:

1. A method of a forming helical cylindrical spring form a bar on a cantilevered-mounted rotating mandrel, said rotating mandrel having a cylindrical surface, an axis and an unsupported end, comprising the steps of: feeding an end of said bar onto said cylindrical surface; applying a first source of pressing force to said end at a first position normal to said cylindrical surface; rotating said first source of pressing force at a speed substantially equal to a speed of said mandrel whereby said bar is bent around said mandrel; releasing said first source of pressing force from said end at a second position; said second position being substantially less than 360 degrees from said first position; applying a second source of pressing force to said bar at said first position before said first source of pressing force has rotated to said second position whereby said bar is simultaneously pressed to said cylindrical surface by at least two sources of pressing force; rotating said second source of pressing force at a speed substantially equal to said speed of said mandrel; releasing said second source of pressing force from said bar at said second position; applying successive sources of pressing force at said first position and releasing each of them at said second position whereby a plurality of turns of said helical cylindrical spring are formed; and applying a shifting force to each of said turns to shift each of said turns a predetermined distance toward said unsupported end, the shift being effective to produce a predetermined pitch of said helical cylindrical spring.

2. A method according to claim 1, wherein said first and second positions are angularly spaced apart by substantially more than half a circumference of said cylindrical surface.

3. A method according to claim 1, wherein said predetermined distance includes a first predetermined distance effective to produce a first predetermined pitch and at least a second predetermined distance effective to produce a second predetermined pitch.

4. A method according to claim 1, which includes applying said shifting force between said second and said first positions.

5. A method according to claim 1, wherein said first, second and successive sources of pressing force include a plurality of sectors surrounding, and rotating in synchronism with said rotating mandrel, said pressing force being produced by radially moving each of said sectors into pressing engagement with said bar as it reaches said first position and said releasing is produced by radially moving each of said sectors out of pressing engagement with said bar as it reaches said second position.

* * * * *